United States Patent [19]

Nakano et al.

[11] Patent Number: 4,592,324

[45] Date of Patent: Jun. 3, 1986

[54] IGNITION CONTROL SYSTEM FOR INTERNAL COMBUSTION ENGINES

[75] Inventors: Kazumi Nakano, Kariya; Eiji Takakuwa, Okazaki; Hiroo Utsumi, Kariya, all of Japan

[73] Assignee: Nippondenso Co., Ltd., Kariya, Japan

[21] Appl. No.: 669,878

[22] Filed: Nov. 9, 1984

[30] Foreign Application Priority Data

Nov. 16, 1983 [JP] Japan ..... 58-215666

[51] Int. Cl.[4] ..... F02P 11/00

[52] U.S. Cl. ..... 123/424; 123/427

[58] Field of Search ..... 123/416, 417, 427, 479, 123/630, 424

[56] References Cited

U.S. PATENT DOCUMENTS 4,212,280 7/1980 Freson et al. ..... 123/611
4,239,024 12/1980 Leichle ..... 123/416
4,370,962 2/1983 Hosaka ..... 123/416
4,414,949 11/1983 Honig et al. ..... 123/417 X

FOREIGN PATENT DOCUMENTS 5406 1/1980 Japan .
54669 4/1980 Japan .

*Primary Examiner*—Tony M. Argenbright
*Attorney, Agent, or Firm*—Cushman, Darby & Cushman

[57] ABSTRACT

An ignition control system for controlling an ignition timing of an internal combustion engine when the CPU is failed or the engine is started, includes a charging and discharging circuit in which a predetermined crank angle range is converted into a voltage to be charged in which the charged voltage is discharged so as to form a charge and discharge voltage wave, a charge and discharge voltage wave comparison circuit for comparing the charge and discharge voltage wave with a battery voltage wave, and a back-up circuit for control the ignition timing in accordance with the signal from the charge and discharge voltage wave comparison circuit.

8 Claims, 12 Drawing Figures

IGNITION CONTROL SYSTEM FOR INTERNAL COMBUSTION ENGINES

BACKGROUND OF THE INVENTION

1. Field of the Invention

The present invention relates to an ignition control system for internal combustion engines and more particularly to an ignition coil ignition control system which is useful in case of a failure of a computing ignition control unit or the like. The internal combustion engine will hereinafter be simply referred to as an engine.

2. Description of the Prior Art

With a view to meeting the requirements of the reduced ignition coil size and the increased rotational speed, there has recently been a tendency toward increasing the flow of energizing current to the ignition coil and decreasing the dwell period. Techniques are known in the art by which the duration of current flow to the ignition coil is controlled at a constant duration time in accordance with the battery voltage by means of a computing control unit using a microcomputer and the control units of this type are shown, for example, in Japanese Laid-Open patent applications Nos. 55-5406 and 55-54669.

However, the computing control units of the type employing a microcomputer for controlling the dwell period must ensure the function of interrupting the current flow to the ignition coil when the microcomputer fails. Therefore, while it is conceivable to substitute a timer circuit for the back-up function which ensures the function of interrupting the current flow to the ignition coil, there is a disadvantage that in order to overcome the danger of a power transistor being broken by an excessively large current or the ignition performance being deteriorated by an excessively small current, the timer circuit must be provided with an additional function for varying its control of maintaining constant the duration of current flow to the ignition coil in accordance with the battery voltage and otherwise the timer circuit cannot be useful as a protective circuit capable of performing the back-up function.

SUMMARY OF THE INVENTION

With a view to overcoming the foregoing deficiencies in the prior art, it is an object of the present invention to provide an ignition control system of the type employing a computing control unit for controlling the energization starting timing and ignition timing of the ignition coil of an engine, which is capable of performing a back-up function of ensuring the ignition control of the ignition coil even in the case of a failure of the computing control unit or the like and also providing an improved starting performance.

It is another object of the invention to provide an ignition control system capable of performing a backup function which ensures the proper ignition control corresponding to the rotation speed of the engine.

It is still another object of the invention to provide an ignition control system so designed that even during the back-up period the current flow to the ignition coil is limited to below a predetermined value so as to protect the ignition coil.

In accordance with the present invention there is thus provided an ignition control system of the type employing a computing control unit for controlling the energization starting timing and ignition timing of the ignition coil, which has the effect of ensuring the ignition control of the ignition coil and improving the safety of the ignition control system even in the case of a failure of the computing control unit. There is another effect of improving the starting performance of the engine during the starting period.

DESCRIPTION OF THE PREFERRED EMBODIMENTS

Figure 1:
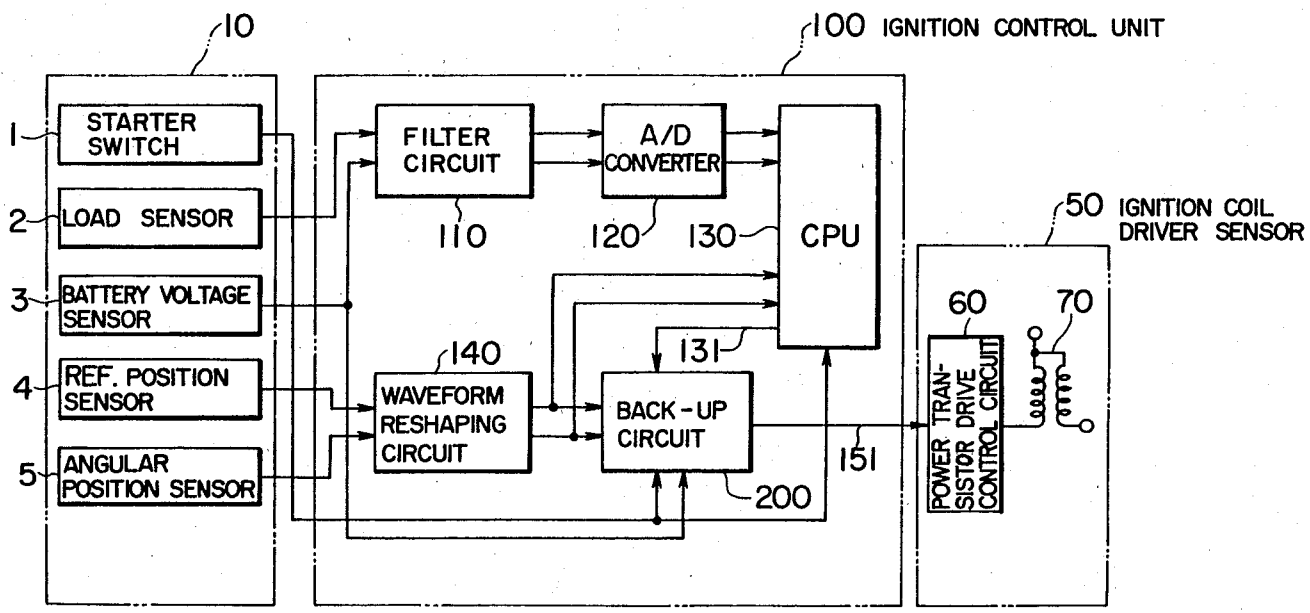
FIG. 1 is an overall block diagram of an ignition control system according to a first embodiment of the invention.

Preferred embodiments of the present invention will be described with reference to the drawings. FIGS. 1 to 4 are block diagrams for a first embodiment of the invention. FIG. 1 is a block diagram showing the overall construction of the first embodiment including a sensor section 10, an ignition control unit 100 and an ignition coil driver section 50.

The sensor section 10 includes a starter switch 1 for operating a starter attached to the engine, a load sensor 2 (e.g., an intake air flow sensor or an intake pipe pressure sensor) for detecting the load condition of the engine, a battery voltage sensor 3 for detecting the terminal voltage signal of the battery which is not shown, a reference position sensor 4 (G sensor) for detecting a reference position (e.g., the top dead center position) of the crankshaft in accordance with the signal from a rotational angle sensor which rotates in synchronism with the rotation of the engine, and an angular position sensor 5 (N Sensor) for detecting an angular position (e.g., the position at intervals of 30 crank angle degrees) of the crankshaft in accordance with the signal from the engine angular position sensor in the like manner as the reference position sensor 4.

The ignition control unit 100 forms a computing control unit responsive to the signals from the sensor section 10 to generate a drive signal for the ignition coil driver section 50.

The ignition control unit 100 includes a filter circuit 110, an A-D converter 120, a CPU 130, a waveform reshaping circuit 140, a back-up circuit 200, etc. The filter circuit 110 receives the signals from the load sensor 2 and the battery voltage sensor 3 so that after the noise has been removed, the output signals of the filter circuit 110 are applied to the A-D converter 120 which in turn converts the signals to digital signals and eventually applies then to the CPU 130. On the other hand, the waveform reshaping circuit 140 receives the signals from the reference position sensor 4 and the angular position sensor 5 and the reshaped signals from the waveform reshaping circuit 140 are applied to the CPU 130 and the back-up circuit 200. The back-up circuit 200 receives the signal from the starter switch 1 and the computed ignition timing signal (IGt signal) from the CPU 130 through a cable 131. The back-up circuit 200 applies a final ignition timing signal to a power transistor drive control circuit 60 of the ignition coil driver section 50 through a cable 151 and thus the power transistor drive control circuit 60 controls the flow of charging current to an ignition coil 70. In other words, a function is performed so that when a predetermined current value is exceeded, the ignition coil charging current is interrupted so as to protect the power transistor from the excessive current.

Figure 2:
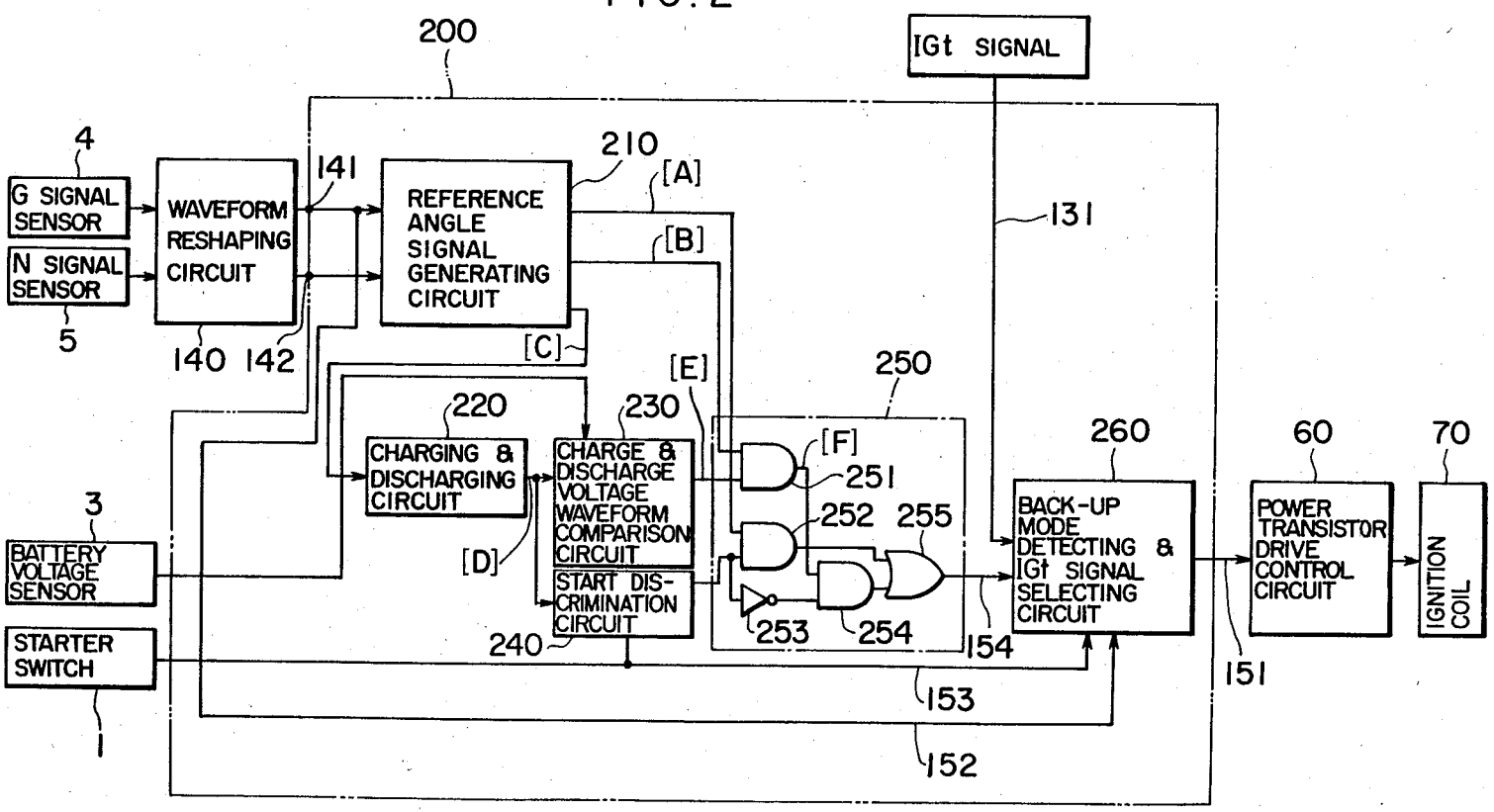
FIG. 2 is a block diagram of the back-up circuit in the embodiment of FIG. 1.

Referring now to FIG. 2, the internal construction of the back-up circuit 200 will be described. The back-up circuit 200 includes a reference angle signal generating circuit 210, a charging and discharging circuit 220, a charge and discharge waveform comparison circuit 230, a start discrimination circuit 240, a logic circuit 250, a back-up mode detecting and IGt signal selecting circuit 260, etc.

The reference angle signal generating circuit 210 receives the reference position signal G from the reference position sensor 4 and the angle position signal N from the angular position sensor 5 through cables 141 and 142, respectively. The reference angle signal generating circuit 210 generates as its output signals those signals shown at A, B and C of FIG. 2. The signal A is an ignition signal for the starting period, the signal B an ignition signal at high engine speeds (usually a guard is provided for the dwell time at very high speeds), and the signal C a charging period signal for the charging and discharging circuit 220.

The signal A is applied to an AND circuit 252 of the logic circuit 250 and the signal B is applied to the other AND circuit 251. The signal C is applied to the charging and discharging circuit 220.

The charging and discharging circuit 220 receiving the signal C applies a charge and discharge voltage signal to the charge and discharge voltage waveform comparison circuit 230 and the start discrimination circuit 240, respectively. The signal (signal E) from the charge and discharge waveform comparison circuit 230 is applied to the AND circuit 251 so that the AND logic operation is performed on the signals B and E and the resulting output signal (signal F) is applied to an AND circuit 254.

The signal from the start discrimination circuit 240 is applied to the AND circuit 252 and the AND circuit 254 through an inverter circuit 253.

Also, the signal F is applied to the other terminal of the AND circuit 254. The outputs from the AND circuit 252 and the AND circuit 254 are applied to an OR circuit 255 and the output signal of the OR circuit 255 is applied to the back-up mode detecting and IGt signal selecting circuit 260 through a cable 154. Also, the circuit 260 receives the computed ignition timing signal (IGt signal) from the CPU 130 through the cable 131. On the other hand, the back-up mode detecting and IGt signal selecting circuit 260 also receives the reference position signal G through a cable 152 and the signal from the starter switch 1 through a cable 153. The output signal from the circuit 260 is applied to the power transistor drive control circuit 60 through the cable 151.

Figure 3:
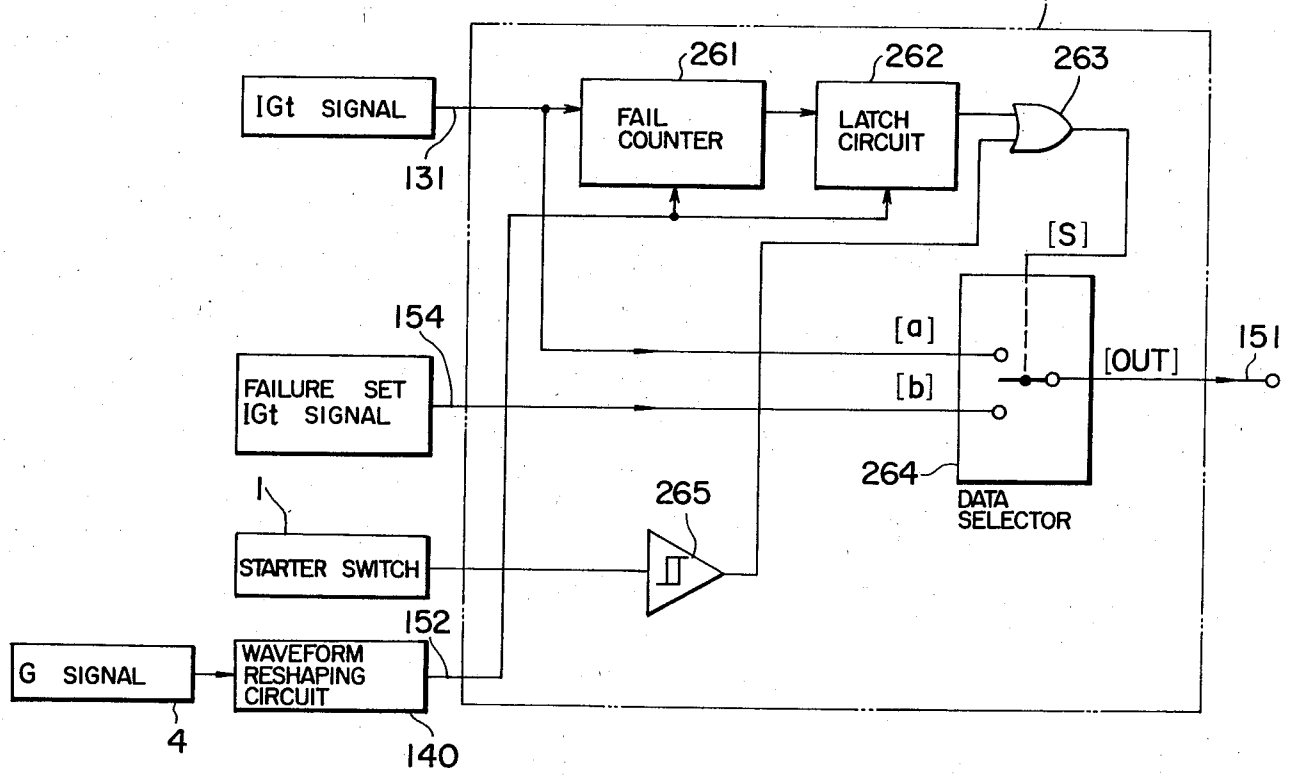
FIG. 3 is a block diagram of the back-up mode detecting and IGt signal selecting circuit shown in FIG. 2.

Referring now to FIG. 3, the internal construction of the back-up mode detecting and IGt signal selecting circuit 260 will be described. Firstly, the computed ignition timing signal (IGt signal) from the CPU 130 is applied through the cable 131 to a fail counter 261 and the terminal a of a data selector 264. A failure set IGt signal is applied through the cable 154 to the terminal b of the data selector 264. The output of an OR circuit 263 is applied to the data select signal terminal S of the data selector 264 and the OR circuit 263 receives at its inputs the output signal of the fail counter 261 (the signal goes to an H level in a failure condition where the ignition signal occurs less than a predetermined number of times) which is latched by a latch circuit 262 and the signal from the starter switch 1 through a Schmitt trigger 265. The reset signal or the reference position signal G from the cable 152 is applied to the reset terminal of the fail counter 261 and the latch circuit 262, respectively.

Figure 4:
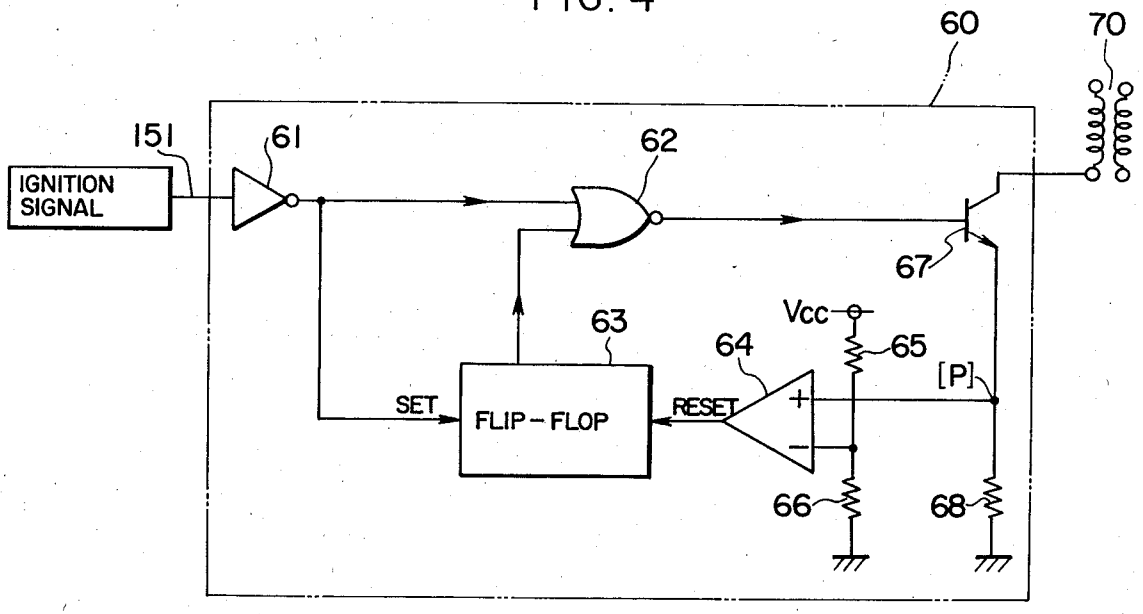
FIG. 4 is a block diagram of the ignition coil drive control circuit shown in the embodiment of FIG. 1.

Referring next to FIG. 4, the internal construction of the power transistor drive control circuit 60 will be described.

The ignition signal is applied through the cable 151 and an inverter 61 to a NOR circuit 62 and the set terminal of a flip-flop circuit 63, respectively, and the output from the flip-flop 63 is applied to the NOR circuit 62. The output signal from a comparator 64 is applied to the reset terminal of the flip-flop circuit 63. The comparator 64 receives the signal generated at a point P and proportional to the magnitude of the primary current supplied to the ignition coil 70 through a power transistor 67 and a resistor 68 and a comparison voltage value determined by the ratio between resistors 65 and 66.

The operation of the control system according to the first embodiment will now be described.

The operation of the control system in the normal conditions (excluding the starting period) will be described first with reference to FIGS. 1 to 5.

In FIG. 1, the load signal from the load sensor 2 and the battery voltage signal from the battery voltage sensor 3 are each subjected to noise component suppression by the filter circuit 110, subjected to A-D conversion by the A-D converter 120 and read in as information by the CPU 130.

Figure 5:
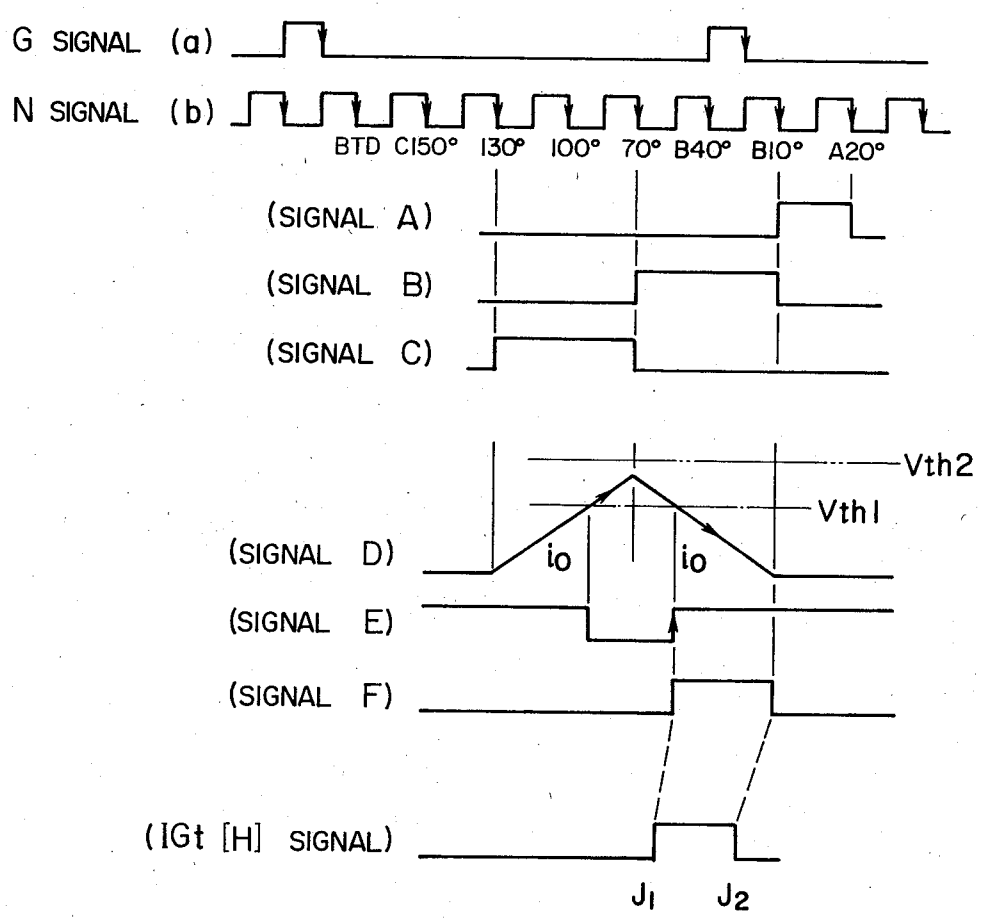
FIG. 5 is a time chart for the back-up circuit in the embodiment of FIG. 1.

The reference position sensor signal G (the signal (a) of FIG. 5) from the reference position sensor 4 and the angular position sensor signal N (the signal (b) of FIG. 5) from the angular position sensor 5 are each reshaped by the waveform reshaping circuit 140 and the reshaped signals are applied to the CPU 130. The CPU 130 detects the engine operating condition from the information of the load signal and the battery voltage signal and the optinum ignition timing and ignition coil charging timing control values are calculated. As the result of the calculation, the CPU 130 generates and applies an ignition coil drive signal (IGt signal) to the back-up circuit 200 through the cable 131. If the CPU 130 is in the normal condition, in the back-up circuit 200 the data selector 264 of the back-up mode detecting and IGt signal selecting circuit 260 applies the computed ignition signal (IGt signal) from the CPU 130 to the power transistor drive control circuit 60 through the cable 131, the input terminal a and the output terminal OUT of the data selector 264 and the cable 151. Then, during the back-up period the ignition signal is applied to the input terminal b of the data selector 264 but it is not delivered to the output terminal. The signal H of FIG. 5 indicates the computed ignition signal (IGt) signal) generated from the CPU 130 in the normal condition. Symbol $j_1$ designates the coil charging starting timing and $j_2$ the ignition timing.

Next, the operation of the ignition control system of the first embodiment during the back-up conditions (including the starting period) will be described with reference to FIGS. 1 to 4 and FIG. 5 showing the time chart of the back-up circuit 200. The operation of the system under the normal operating condition (e.g., the running condition of 40 km/h) will be described first with reference to FIG. 1. The reference position signal G from the reference position sensor 4 and the angular position signal N from the angular position sensor 5 are reshaped by the waveform reshaping circuit 140 and the reshaped signals are applied to the reference angle signal generating circuit 210 of the back-up circuit 200 thereby generating from the circuit 210 the signals A, B and C shown in FIG. 5. With these signals, the H level period of the signal C, that is, the time interval from 130 to 70 degrees BTDC is a charging period during which the capacitor (not shown) is charged with a constant charging current of $i_0$ in the charging and discharging circuit 220 of the back-up circuit 200 shown in FIG. 2. This charging period is from 130 to 70 degrees BTDC and it is designed so that after passing 70 degrees BTDC the capacitor is discharged with a discharge current $i_0$ of the same value as the charging current $i_0$ and the discharging is completed at 10 degrees BTDC. The voltage across the charge and discharge capacitor is the voltage at a point D and it is shown in FIG. 5. More specifically, the voltage at the point D starts rising with the current $i_0$ at 130 degrees BTDC, reaches the maximum value at 70 degrees BTDC and decreases with the discharge current $i_0$ until 10 degrees BTDC. Thus, an equally sloped triangular waveform is produced which reaches the maximum voltage value at 70 degrees BTDC in inverse proportion to the engine speed.

Then, the voltage signal at the point D is applied to the charge and discharge waveform comparison circuit 230 and the start discrimination circuit 240. When the voltage signal at the point D is applied to the charge and discharge waveform comparison circuit 230, the voltage signal is compared with a given threshold voltage $V_{th1}$ (variable with the battery voltage 3 in such a manner that the threshold voltage $V_{th1}$ decreases with an increase in the battery voltage and increases with a decrease in the battery voltage) and a charge and discharge waveform comparison signal (signal E) is generated. Then, the logical product of the signals E and B is produced by the AND circuit 251 and the resulting output is used as an ignition signal F in the back-up mode of operation.

Then, during the high speed operation the maximum value of the voltage at the point D is decreased with an increase in the engine speed. In other words, while the same charging current $i_0$ is also used at higher speeds, the charging time is decreased with an increase in the rotation speed. While the coil charging starting timing must be advanced with a decrease in the maximum value of the voltage at the point D, the point D voltage is decreased further as the rotation speed is increased further. Then, a condition occurs in which the point-D voltage becomes lower than the threshold voltage $V_{th1}$. However, since the threshold voltage $V_{th1}$ must be preset higher than a given noise-proof voltage value in consideration of the antinoise characteristic, etc., in relation to the rotation speed there is a certain limitation to the determination of the coil charging starting timing through the comparison of the threshold voltage $V_{th1}$ and the voltage at the point D. To prevent this, it is designed so that under high speed conditions where the point-D voltage becomes lower than the threshold voltage $V_{th1}$, the signal E of FIG. 2 goes to the H level and the signal B is used as such as an ignition signal for the back-up mode of operation. In other words, the dwell time guard control is also performed at the high speed operation.

Next, the operation during the starting period will be described. While the starting of the engine is discriminated by the start discrimination circuit 240 in accordance with the signal from the starter switch 1, the following control is effected assuming other cases where the starter is not used (e.g., force engaged conditions). During the starting period the engine speed is also low so that the signal C (the charging period signal having a constant width of 60° crank angle) is increased in terms of time and thus the peak of the point-D voltage (the charging voltage) is increased. In other words, the start discrimination can be effected by comparing a threshold voltage $V_{th2}$ (preset to a voltage corresponding to the starting period, e.g., the rotation speed of about 350 rpm) and the voltage at the point D in the start discrimination circuit 240. When the starting condition is discriminated by the start discrimination circuit 240, the signal A is delivered as an ignition signal through the cable 154. This selection of the proper ignition signal for the starting condition is effected by the logic circuit 250. When the starting condition is discriminated by the start discrimination circuit 240 (or equally when the starter switch 1 is on), the start discrimination circuit 240 generates an H level signal. In other words, the AND circuit 252 applies the signal A to the OR circuit 255. Also, an L level signal is applied to the AND circuit 254 and thus the signal F is not applied to the OR circuit 255.

On the contrary, if the engine is not in the starting condition, the start discrimination circuit 240 generates an L level signal so that the signal A is masked by the AND circuit 252 and conversely the signal F is generated from the AND circuit 254. Thus, the signal F is used as an ignition signal.

Next, the operation of the back-up mode detecting and IGt signal selecting circuit 260 will now be described with reference to FIG. 3.

The preset conditions for switching to the backup mode include one where the number of computed ignition signals (IGt signals) from the CPU 130 is different from a predetermined number of ignition events (a failure is determined when either the number is greater than or smaller than the predetermined number) and another where the battery voltage is low and the variation of the rotation speed is considerably great thus making the computation of the CPU 130 difficult.

The processing performed in case of an ignition signal failure will be described first. The ignition timing signal (IGt signal) from the CPU 130 is applied to the fail counter 261 via the cable 131. Also, the reference position sensor signal is applied as a reset signal to the counter 261. In other words, if the predetermined number of ignition event do not take place during the interval between the successive reference position sensor signals G, the fail counter 261 generates an H level signal and the following latch circuit 262 latches the signal for a given interval of time. Since the resetting is effected by the reference position sensor signal G in the circuit 260, the signal is latched for the interval between the reference position sensor signals G. The latched signal is then applied to the select terminal S of the data selector 264 through the OR circuit 263. Also, during the starting period the starter switch 1 applies its output signal (the signal which goes to the H level upon starting) to the select terminal S of the data selector 264 through the Schmitt trigger circuit 265 and the OR circuit 263. In other words, when a failure occurs, the switch of the data selector 264 is thrown to the terminal b and the failure set IGt signal is delivered on the cable 151. On the contrary, in the normal condition the switch of the data selector 264 is thrown to the terminal a and the computed ignition signal (IGt signal) from the CPU 130 is delivered on the cable 151.

Next, the operation of the power transistor drive control circuit 60 will be described with reference to FIG. 4. The ignition signal applied from the cable 151 is applied to the flip-flop 63 and the NOR circuit 62, respectively, through the inverter 61. The power transistor 67 is turned on by the ignition signal and an ignition coil charging current is supplied. The voltage at the point P is increased in accordance with the magnitude of the ignition coil charging current. The point-P voltage is compared with the comparison voltage value or the voltage value determined by the resistance division by the resistors 65 and 66 in the comparator 64 so that when the primary charging current of the ignition coil exceeds a predetermined current value, the comparator 64 generates an overcurrent indicative signal. This signal is applied as a reset signal to the flip-flop 63 so that when the ignition coil charging current reaches the predetermined current value, the ignition signal is changed to the L level and the current flow to the power transistor 67 is interrupted.

Figure 6:
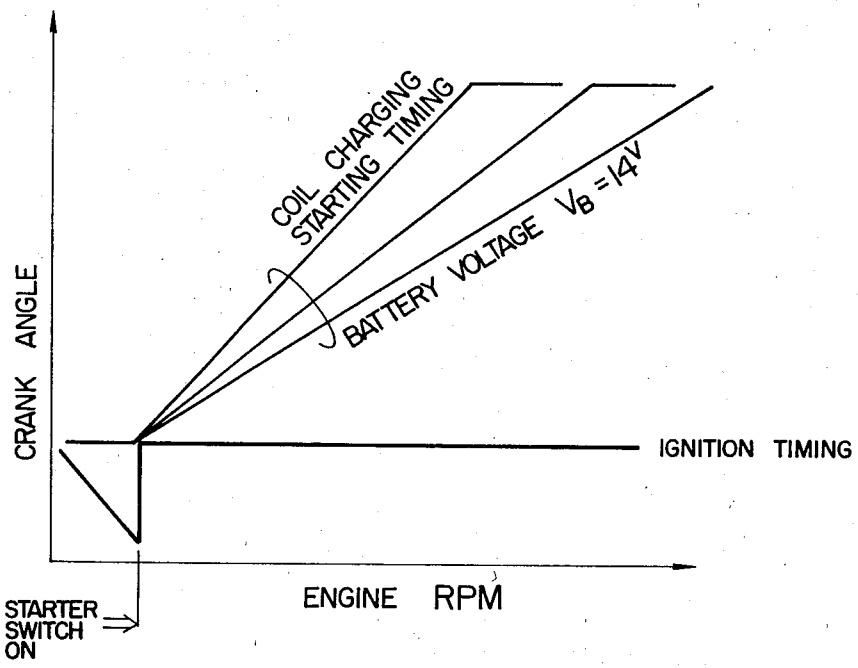
FIG. 6 is a characteristic diagram showing the ignition timing characteristics during the back-up period of the embodiment of FIG. 1.

FIG. 6 shows the dwell time and ignition timing control characteristics of the present invention in the back-up mode of operation.

In accordance with the present embodiment, in the back-up mode the charging and discharging currents $i_0$ are used to produce a charge and discharge voltage waveform or triangular waveform having a peak value corresponding to the engine speed with the peak at 70 degrees BTDC within the interval from 130 to 10 degrees BTDC and the charge and discharge voltage waveform is compared with the voltage value corresponding to the battery voltage thereby providing the desired back-up mode ignition signal by means of the resulting signal. During the high speed and strarting periods, the desired ignition signal is provided by a signal produced by the reference position and angle position signals. As a result, even in the back-up mode the proper ignition signal can be applied to the ignition coil in accordance with the engine condition and the battery voltage condition by means of the simple circuit construction.

Figure 7:
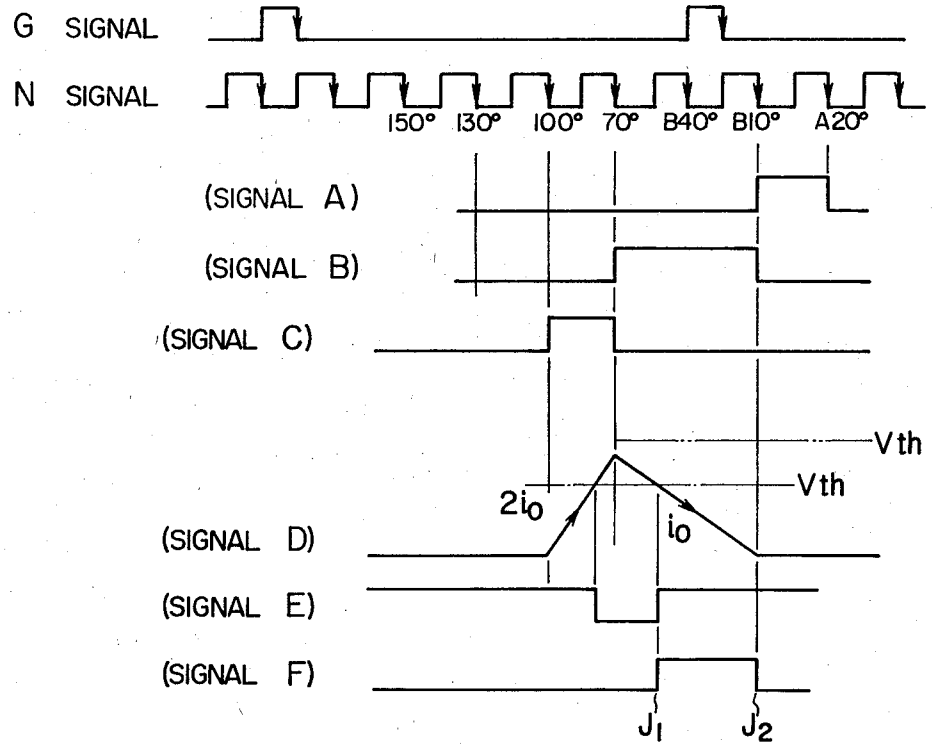
FIG. 7 is a time chart for the back-up circuit in a second embodiment of the invention.

A second embodiment of the invention will now be described. FIG. 7 shows a time chart for the second embodiment. The second embodiment differs from the first embodiment in that the duration of the charging period signal or the signal C from the reference angle signal generating circuit 210 is reduced to the interval of 30 degrees from 100 to 70 degrees BTDC and the charging period is reduced to one half that of the first embodiment. However, if the same charging current $i_0$ is used, there is an inconvenience of decreasing the peak voltage to one half as compared with the first embodiment. Thus, the changing and discharging circuit 220 uses a charging current of $2i_0$ so as to ensure the same maximum value for the peak voltage as in the first embodiment. In accordance with this embodiment, the reduced charging period has the effect of ensuring the back-up function for multicylinder engines (e.g., 8-cylinder engines).

Figure 8:
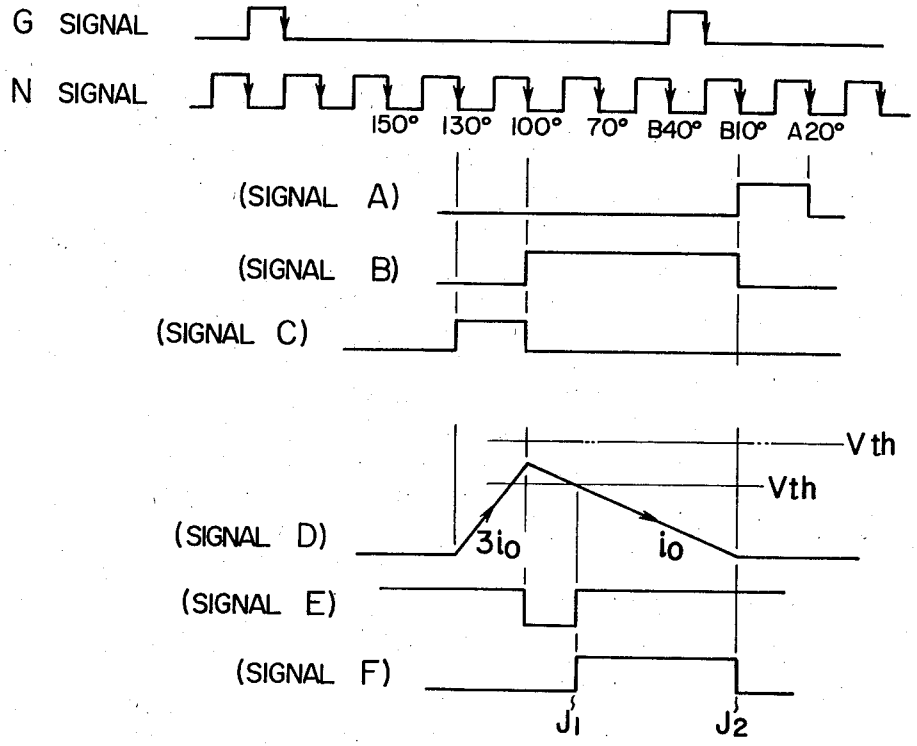
FIG. 8 is a time chart for the back-up circuit in a third embodiment of the invention.

Next, a third embodiment of the invention will be described. FIG. 8 shows a time chart for the third embodiment and the third embodiment differs from the first embodiment in that the charging period signal or the signal C from the reference angle signal generating circuit 210 is reduced in duration to the interval of 30 degrees from 130°to 100 degrees BTDC and advanced by 30 degrees and that the charging current of the charging and discharging circuit 220 is increased to $3i_0$ thereby ensuring a sufficient peak voltage even at higher engine speeds. Also, the discharging period is set to the interval from 100 to 10 degrees BTDC and the charging starting timing for the ignition coil is controlled. In accordance with this embodiment, the back-up function is ensured even in the range of higher engine speeds.

Figure 9:
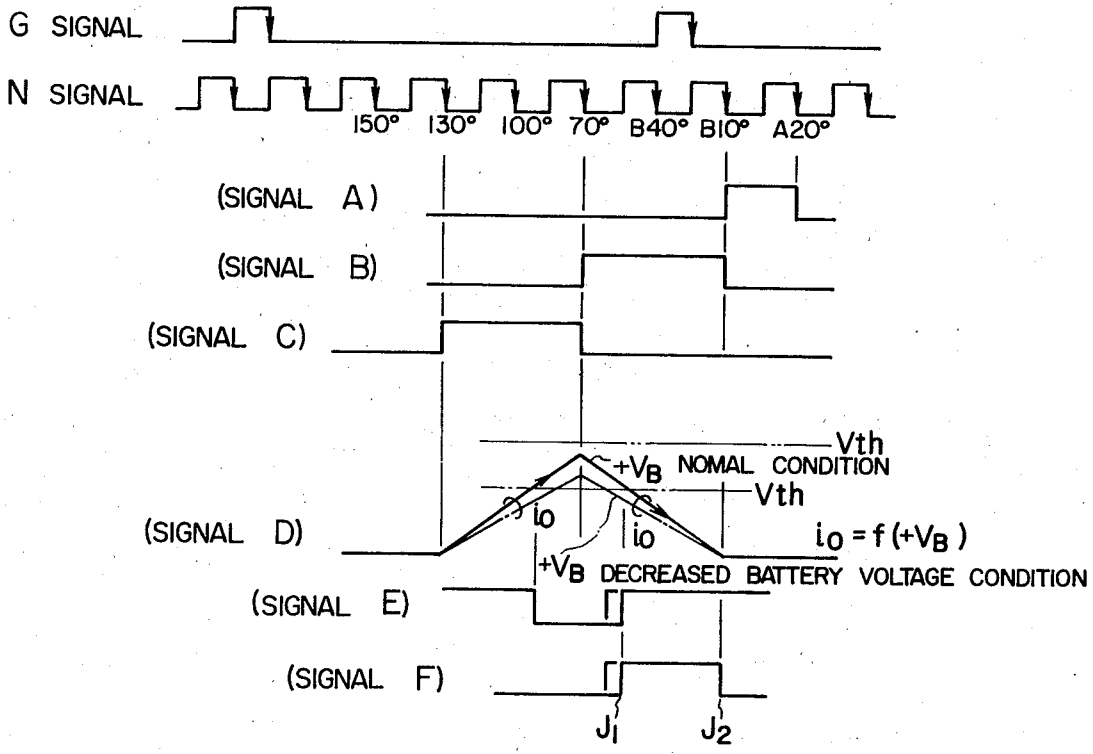
FIG. 9 is a time chart for the back-up circuit in a fourth embodiment of the invention.

A fifth embodiment of the invention will now be described. FIG. 9 shows a time chart for the fifth embodiment which differs from the first embodiment in that the value of the charging and discharging currents $i_0$ is varied in accordance with the battery voltage 3 ($i_0=f(+V_B)$) so as to correct the ignition coil charging starting timing. FIG. 9 shows the charged voltage at the point D in the normal condition and the decreased battery voltage condition, respectively. To vary the charging and discharging currents in accordance with the battery voltage 3 can also be applied to the second, third and fourth embodiments and the range of variation of the ignition coil charging starting timing can be increased in each of the embodiments.

Figure 10:
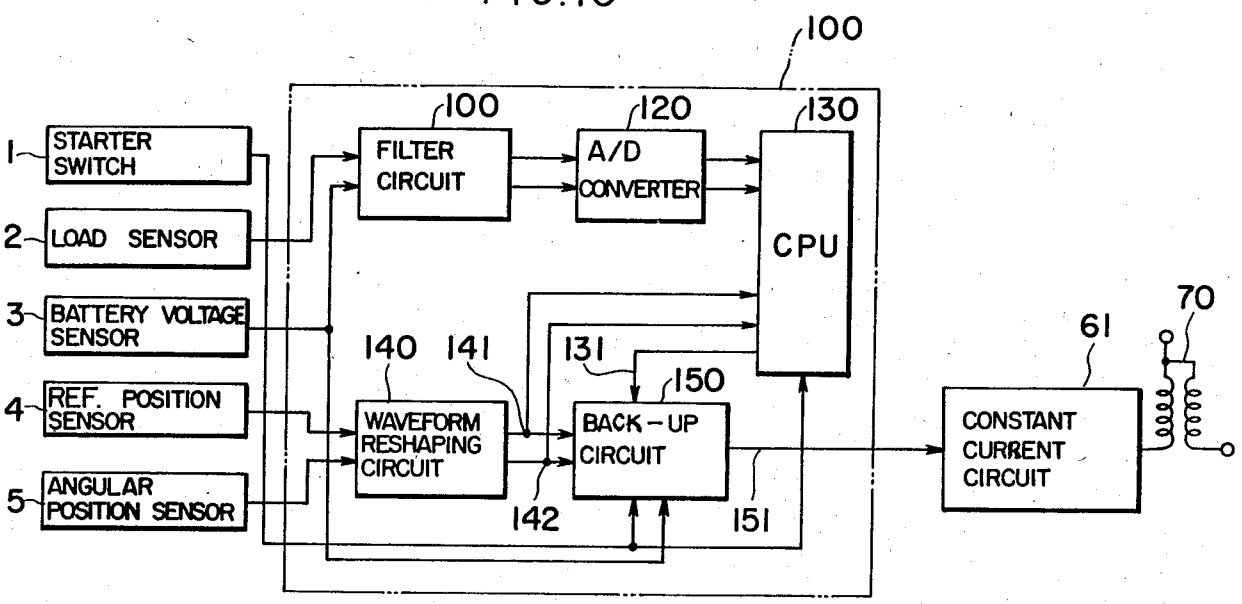
FIG. 10 is an overall block diagram of a fifth embodiment of the invention.
Figure 11:
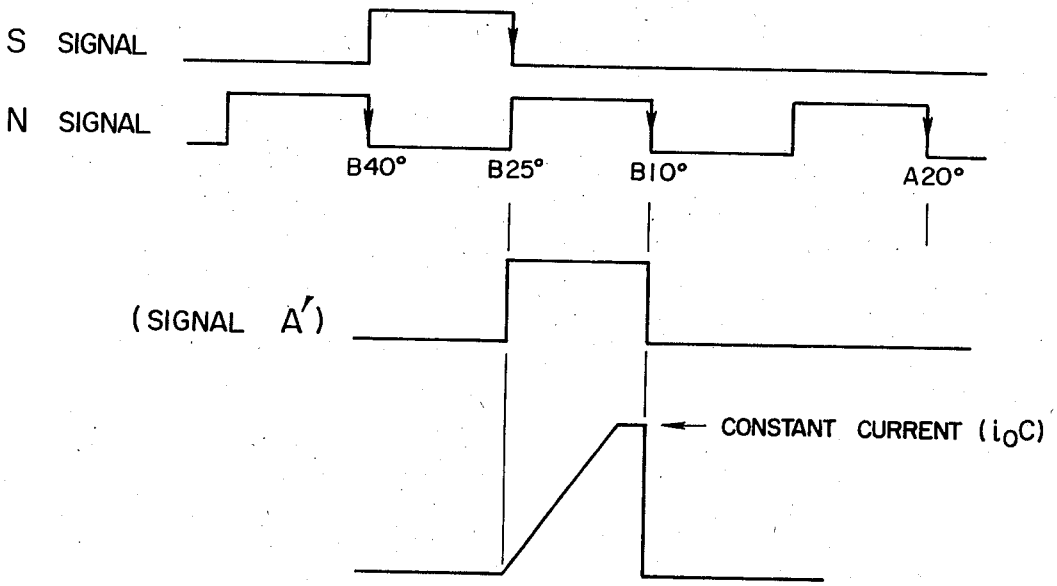
FIG. 11 is a time chart for the control during the starting period in the fifth embodiment.

Next, a sixth embodiment of the invention will be described. FIG. 10 is a block diagram of the sixth embodiment. This embodiment differs from the first embodiment in that the power transistor drive control circuit 60 of the ignition coil driver section 50 is replaced with a power transistor constant current circuit 61. The remaining construction is the same with the counterpart of the first embodiment. The provision of the power transistor constant current circuit 61 prevents the current to be interrupted by the power transistor from increasing unnecessarily. Also, the power transistor constant current circuit 61 incorporates a lock preventing function for preventing the ignition coil charging current from flowing continuously (locked condition). FIG. 11 shows the control performed by this embodiment during the engine starting period. A starting period ignition signal (signal A') controls an ignition coil charging current $i_0'$ with a constant current $i_0C$ during the interval from 25 to 10 degrees BTDC (from 10 degrees BTDC to 20 degrees ATDC in the first embodiment). It is to be noted that while the power transistor constant current circuit 61 is used in this embodiment, the control by the signal A' of FIG. 11 during the engine starting period can also be performed without the circuit 61.

Figure 12:
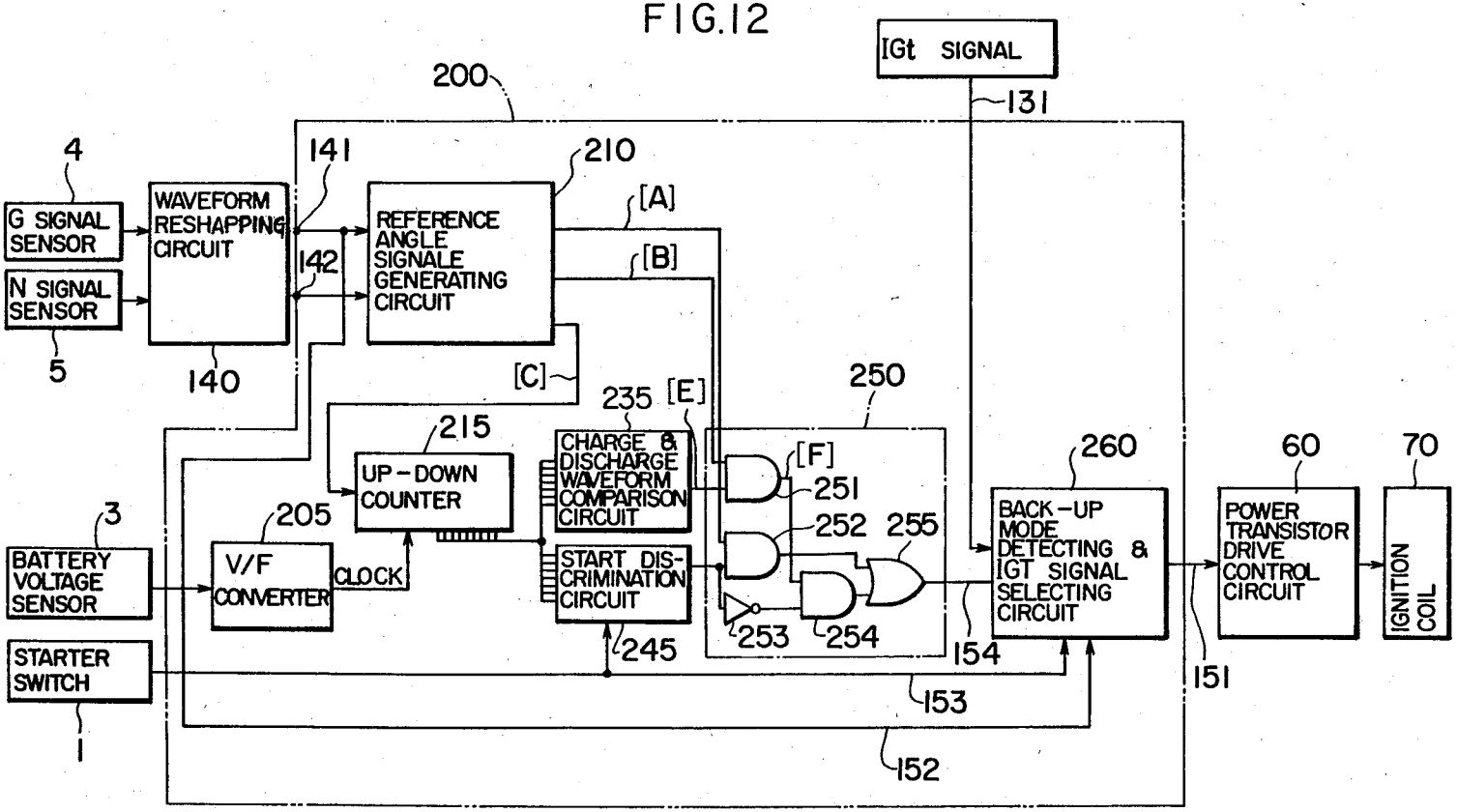
FIG. 12 is a block diagram of the back-up circuit in a sixth embodiment of the invention.

Next, a seventh embodiment of the invention will be described. FIG. 12 is a block diagram of a back-up circuit 200 in the seventh embodiment and while, in the first embodiment, the comparison of the charge and discharge voltage value according to the reference angle signal generating circuit 210 and the battery voltage is performed analogically, the seventh embodiment performs the desired comparison digitally. More specifically, the battery voltage 3 is subjected to voltage-frequency conversion by a V-F converter 205 and then the converted frequency is applied as clocks to an up-down counter 215. The charging period signal from a reference angle signal generating circuit 210 is also applied to the up-down counter 215. The up-down counter 215 counts up in response to the charging period signal, counts down in response to the discharging period signal and applies its output to a charge and discharge waveform comparison circuit 235 and a start discrimination circuit 245 thereby digitably computing the proper ignition coil charging starting timing and ignition timing and applying them to a logic circuit 250. The remaining processing is the same as in the first embodiment. In accordance with this embodiment, the desired back-up signal is generated digitally and thus the ignition coil charging starting timing and the ignition timing can be controlled accurately.

We claim:

1. An ignition control system for use in an internal combustion engine for controlling the energization starting timing and ignition timing of an ignition coil of said engine by computing control means, said ignition control system comprising:

detecting means for detecting at least one of a failure of said computing control means or in the starting of said engine;

charging and discharging means for converting a rotational speed of said engine to a charged voltage and for discharging said converted charged voltage within a predetermined number of degrees from a predetermined crank angle of said engine so as to form a charge and discharge voltage wave;

charge and discharge voltage waveform comparison means for comparing relative magnitudes of said charge and discharge voltage wave with a signal indicative of a batter voltage; and back-up signal generating means responsive to a signal from said charge and discharge waveform voltage comparison means to generate a back-up signal, whereby said energization starting timing and ignition timing of said ignition coil are controlled in accordance with said back-up signal in response to at least one of said computing control means failure or said engine starting.

2. An ignition control system according to claim 1, wherein the number of crank angle degrees, the charging current used by said charging means of said charging and discharging means, and the number of crank angle degrees and discharging current used by said discharging means are variable.

3. An ignition control system according to claim 2, wherein the number of crank angle degrees used by said charging means of said charging and discharging means is selected to be one half the number of crank angle degrees used by said discharging means.

4. An ignition control system according to claim 1, wherein the current value of at least one of the charging and discharging currents of the charge and discharge voltage waveform formed by said charging and discharging means is varied in accordance with said battery voltage.

5. An ignition control system according to claim 1, wherein said battery voltage indicative signal is varied in accordance with the speed of said engine by said charge and discharge voltage waveform comparison means.

6. An ignition control system according to claim 1, wherein said charging and discharging means includes means for generating said charge and discharge voltage waveform formed by said charging and discharging means as a digital signal.

7. An ignition control system according to claim 1, further comprising means for interrupting the flow of an excessively large energizing current in said ignition coil.

8. An ignition control system according to claim 7, further comprising means for limiting the flow of an energizing current in said ignition coil to less than a predetermined value.

* * * * *